US010988937B2

(12) United States Patent
Erickson

(10) Patent No.: US 10,988,937 B2
(45) Date of Patent: Apr. 27, 2021

(54) NON-SLIP RAMP HARDWARE

(71) Applicant: Russell Erickson, Blaine, MN (US)

(72) Inventor: Russell Erickson, Blaine, MN (US)

( * ) Notice: Subject to any disclaimer, the term of this patent is extended or adjusted under 35 U.S.C. 154(b) by 0 days.

(21) Appl. No.: 16/703,984

(22) Filed: Dec. 5, 2019

(65) Prior Publication Data

US 2020/0181919 A1 Jun. 11, 2020

Related U.S. Application Data

(60) Provisional application No. 62/776,277, filed on Dec. 6, 2018.

(51) Int. Cl.
*E04F 11/00* (2006.01)

(52) U.S. Cl.
CPC ..... *E04F 11/002* (2013.01); *E04F 2011/007* (2013.01)

(58) Field of Classification Search
CPC ..... E04F 11/002; E04F 2011/007
USPC ..... 14/69.5–72.5
See application file for complete search history.

(56) References Cited

U.S. PATENT DOCUMENTS 5,347,672 A * 9/1994 Everard ..... A61G 3/061 14/69.5
6,923,140 B1 * 8/2005 Cook ..... E01D 15/24 114/362
7,827,641 B2 * 11/2010 Hoffman ..... B65G 69/30 14/69.5
8,448,278 B1 * 5/2013 Beilstein ..... B65G 69/30 14/69.5
8,495,779 B2 * 7/2013 Metcalfe ..... B65G 69/30 14/69.5
8,695,151 B2 * 4/2014 Dilyard ..... B32B 5/26 15/230
8,813,289 B1 * 8/2014 Clark ..... E04F 11/002 14/69.5
8,914,932 B2 * 12/2014 Romanak ..... B65G 69/30 14/69.5
8,959,693 B2 * 2/2015 Pohlman ..... E01D 1/00 14/69.5
2005/0015899 A1 * 1/2005 Jeruss ..... B65G 69/287 14/69.5
2006/0200919 A1 * 9/2006 Frahm ..... B60P 1/43 14/69.5
2014/0230167 A1 * 8/2014 Romanak ..... B60P 1/43 14/69.5
2014/0271100 A1 * 9/2014 Giemza ..... B65G 69/30 414/813

* cited by examiner

*Primary Examiner* — Raymond W Addie
(74) *Attorney, Agent, or Firm* — Vidas Arrett & Steinkraus P.A.

(57) ABSTRACT

A method or system for constructing a non-slip ramp having at least two sloped ramp stringers and a starter wedge having a sloped side and an open side. A non-slip deck board is slid into the open side of the starter wedge and at least two tread plates, each providing spacing between two adjacent non-slip deck boards, each tread plate having a flat top section with a substantially L-shaped section attached perpendicular to the flat top section, with the bottom of the L fitting below one of the adjacent deck boards. The at least two tread plates are attached to the at least two sloped ramp stringers and an end-cap attached to a last non-slip deck board.

10 Claims, 18 Drawing Sheets

NON-SLIP RAMP HARDWARE

CROSS-REFERENCE TO RELATED APPLICATIONS

This application claims the benefit of and priority to U.S. Provisional Application No. U.S. 62/776,277, filed Dec. 6, 2018, the entire contents of which is hereby incorporated by reference.

STATEMENT REGARDING FEDERALLY SPONSORED RESEARCH

Not Applicable.

BACKGROUND OF THE INVENTION

Building ramps is currently a difficult, complicated and time consuming process. What is needed is a way a convenient, reliable and safe way of creating ramps. The components included with the inventive system allow you to quickly assemble ramps that integrate your chosen composite, PVC, wood or similar decking material of choice and using appropriate off the shelf hardware assemble with fewer steps, hardware or measurements needed.

Without limiting the scope of the invention a brief summary of some of the claimed embodiments of the invention is set forth below. Additional details of the summarized embodiments of the invention and/or additional embodiments of the invention may be found in the Detailed Description of the Invention, below.

A brief abstract of the technical disclosure in the specification is provided as well only for the purposes of complying with 37 C.F.R. 1.72. The abstract is not intended to be used for interpreting the scope of the claims.

BRIEF SUMMARY OF THE INVENTION

The invention provides a system and method for constructing a non-slip ramp having at least two sloped ramp stringers and a starter wedge having a sloped side and an open side. A non-slip deck board is slid into the open side of the starter wedge and at least two tread plates, each providing spacing between two adjacent non-slip deck boards, each tread plate having a flat top section with a substantially L-shaped section attached perpendicular to the flat top section, with the bottom of the L fitting below one of the adjacent deck boards. The at least two tread plates are attached to the at least two sloped ramp stringers and an end-cap attached to a last non-slip deck board.

While the ramp parts can be made of any desired material, one material which can be used is extruded aluminum which is cut and folded to form the parts, the starter wedge, the tread plates, the side caps and the end cap.

If desired, heat cable for melting snow and ice from the non-slip ramp can also be provided.

The sloped side of the starter wedge can have any desired angle, but one angle which could be used is an angle suitable for ramp building codes of one inch rise over twelve inch run.

DETAILED DESCRIPTION OF THE INVENTION

Figure 1:
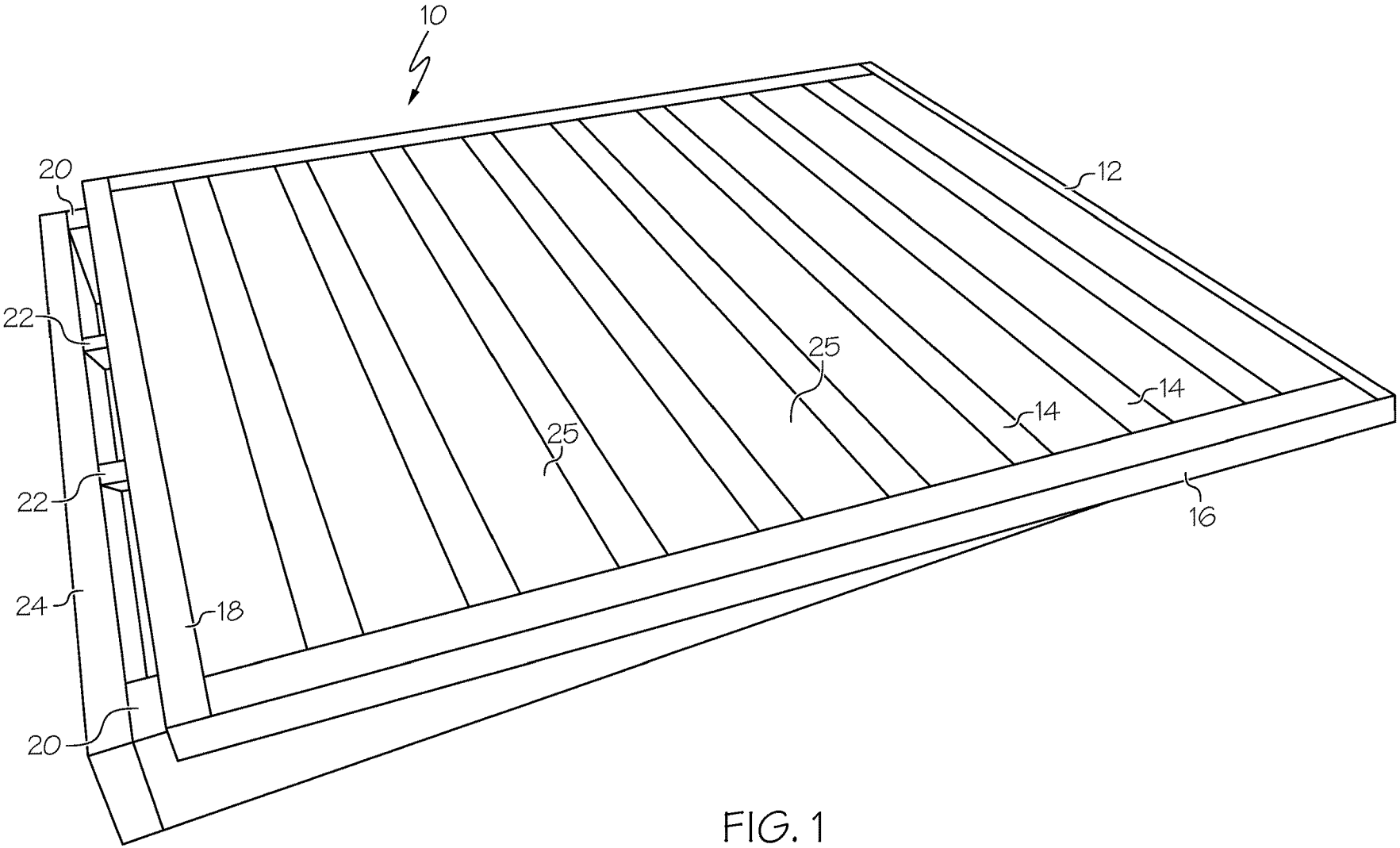
FIG. 1 shows a complete ramp.

Referring now to FIG. 1, the inventive non-slip ramp hardware system is shown, which provides a new way of mounting composite, PVC or wood materials to form a non-slip ramp to be attached to stairs, decks, porches or similar structures by separate hardware attached to the structure and ground. All hardware included in the ramp system interconnects to create a stable platform with integrated mechanical traction. Additionally, it is possible to integrate third party off the shelf heat cable to further manage accumulation of ice and snow. Because it is a "system" for creating the non-slip ramp you are able to reduce the amount of hardware needed and time needed to construct and install a ramp. The ramp parts can be mixed and matched and modified for different situations. The ramp parts are shown in FIG. 1 and are the starter wedge 12, the tread plates 14, the two side caps 16 (one on either side of the ramp), and the end cap/plate 18, which are assembled with the stringers and decking material to form the ramp. The outside stringers are shown at 20, the inside stringers are shown at 22, and all the stringers 20 and 22 are connected to the ramp end 24, while the decking material is shown at 25. The stringers can be at any angle, but most commonly will be at an angle suitable for ramp building codes, such as providing one inch of rise over twelve inches of run.

Figure 2:
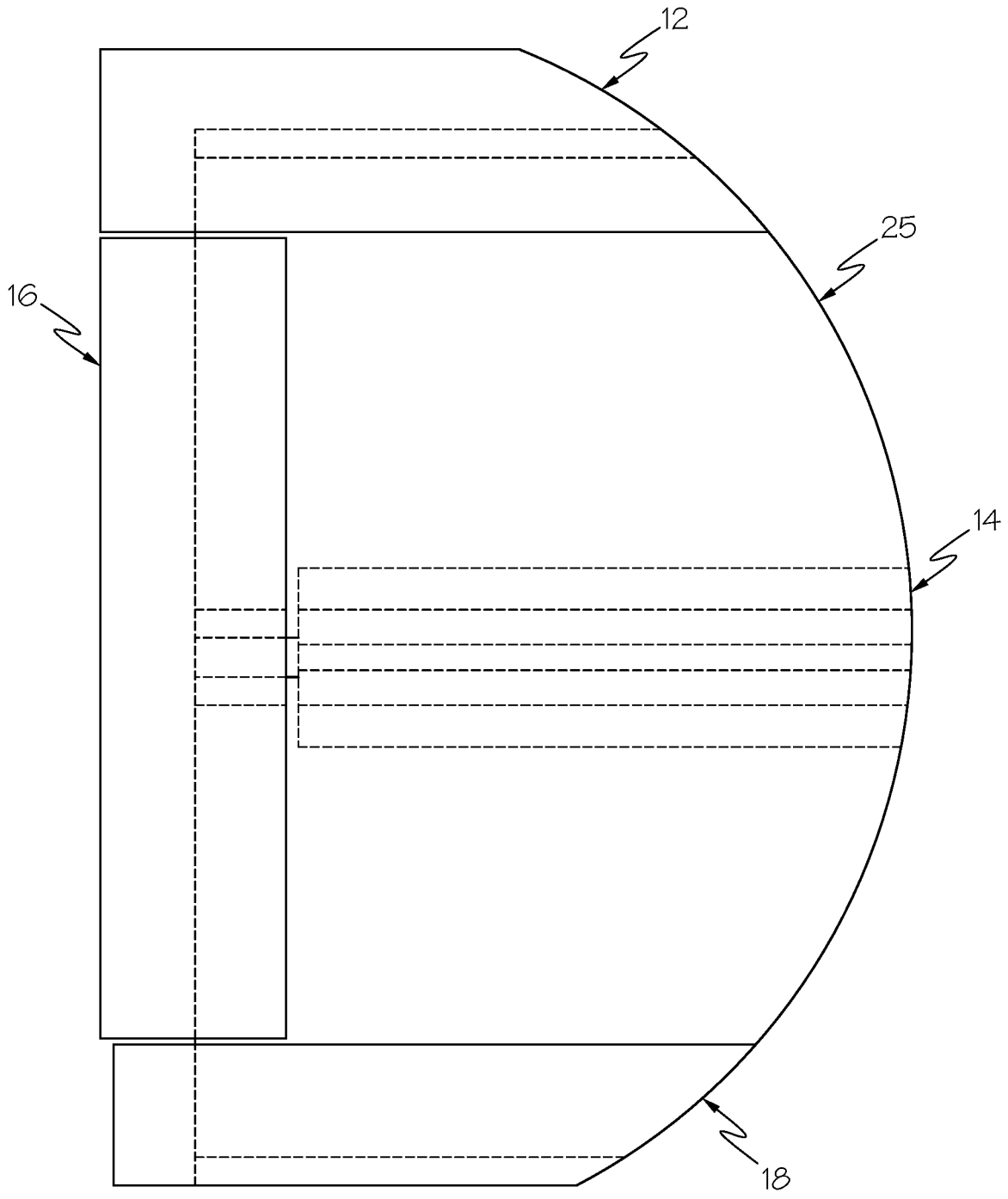
FIG. 2 shows a schematic top view showing the parts of the ramp hardware.

Referring now to FIG. 2, a schematic top view of the inventive ramp is shown, which show the starter wedge part at 12, the decking material at 25, the tread plate part at 14, the side cap part at 16 and the end cap part at 18.

Figure 3:
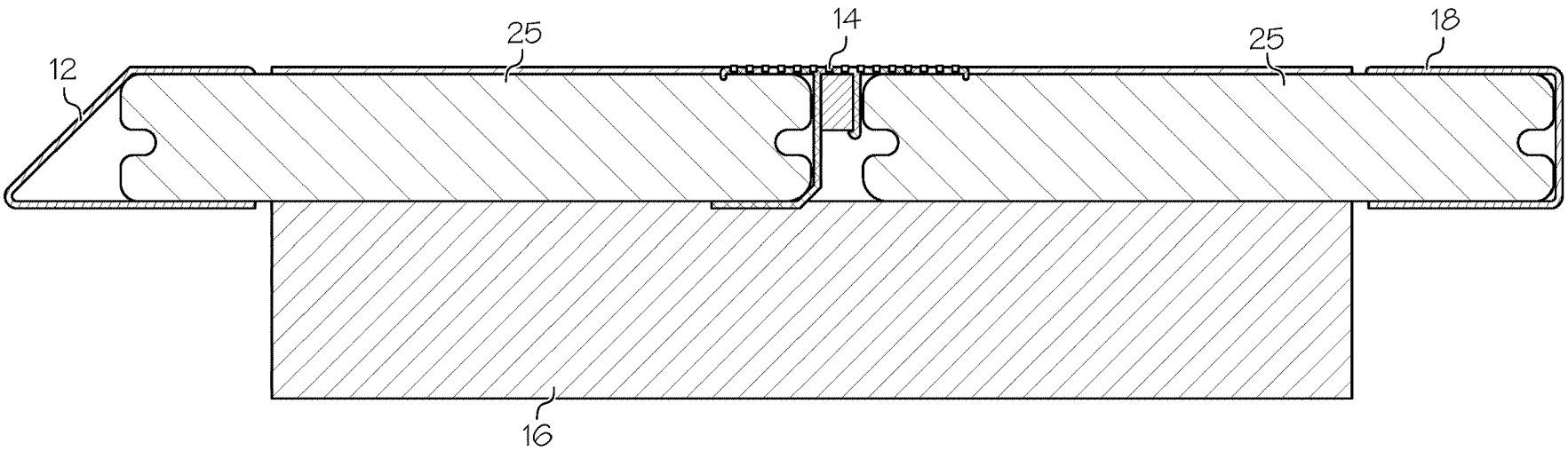
FIG. 3 shows a side cross-section view of the inventive ramp.

Referring now to FIG. 3, a side cross-section view of the inventive ramp is shown, which show the starter wedge at 12, the tread plate at 14, the end cap at 18, the decking at 25 and the side cap shown at 16. After cutting the ramp stringers (20 and 22 best seen in FIG. 1) to length you attach all decking materials needed with off the shelf hardware suitable to the decking material. It should be understood that the decking material 25 can be made of any commercially available material, such as wood, composite material, PVC or other plastic material, or any other desired material, such as metal. The ramp hardware parts 12, 14, 16 and 18 can be made of any desired material as well, but are described as made of extruded aluminum, which can be cut and bent to the final shaped parts, as described below.

Figure 4:
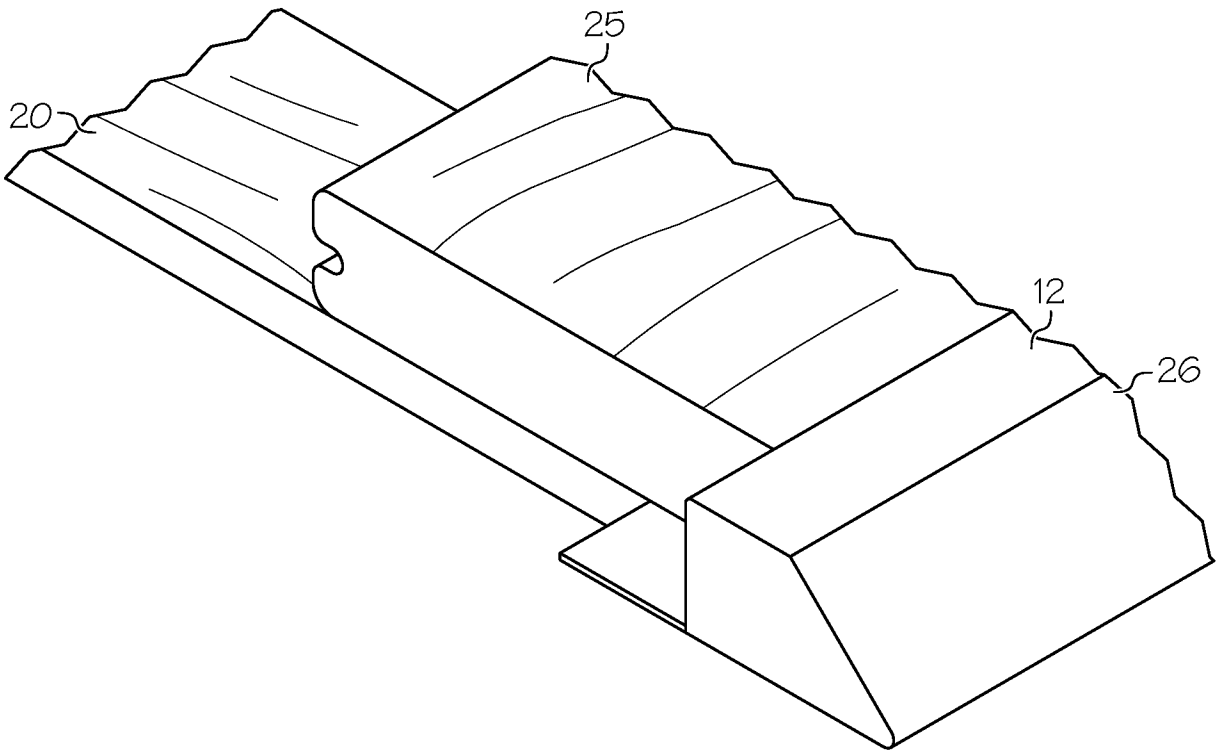
FIG. 4 shows the starter wedge with decking slide into the starter wedge and one outside stringer piece. Including a slot provided for a deck board to fit into.
Figure 5:
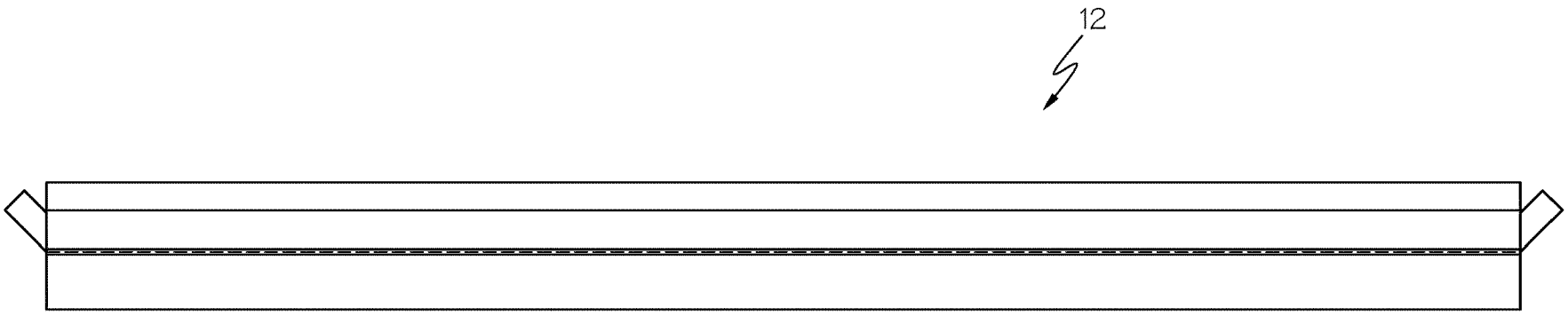
FIG. 5 shows the extruded aluminum piece which is cut and folded at the numbered fold lines shown in FIG. 5 to form the starter wedge.
Figure 6:
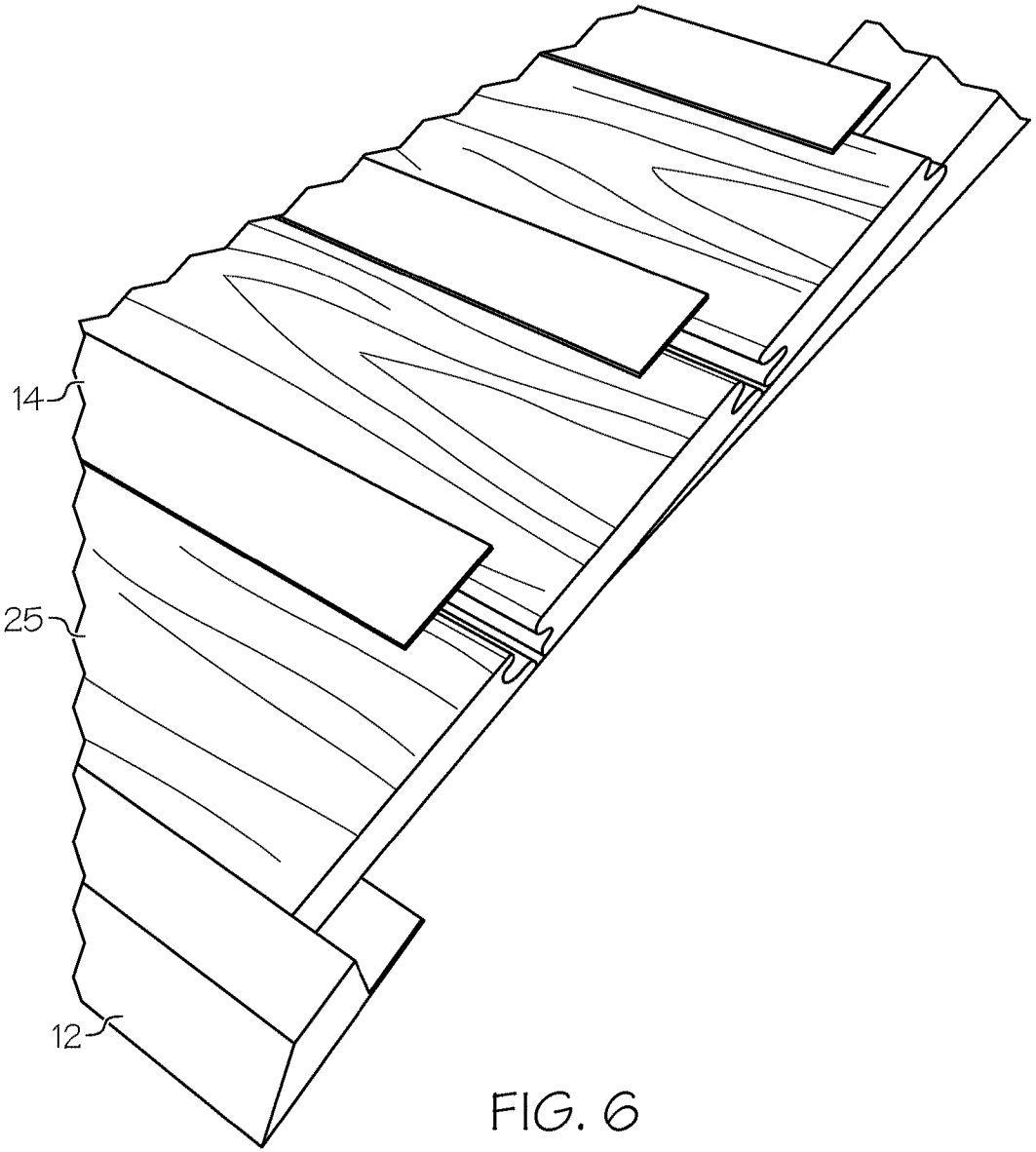
FIG. 6 shows the tread plates in between deck boards.

The starter wedge is shown in more detail in FIGS. 4 and 5. In FIG. 4, the first piece placed is the starter wedge 12, which is secured to the stringers 20 and 22. The starter wedge 12 has a sloped front 26 which extends the starter wedge to the ground at an angle suitable for ramp building codes, such as of one inch rise over a twelve inch run. As shown in FIG. 5, the starter wedge is made out of sheet metal cut and bent five times, as shown in the bend lines of FIG. 5. The starter wedge can be made in any desired width.

Figure 7:
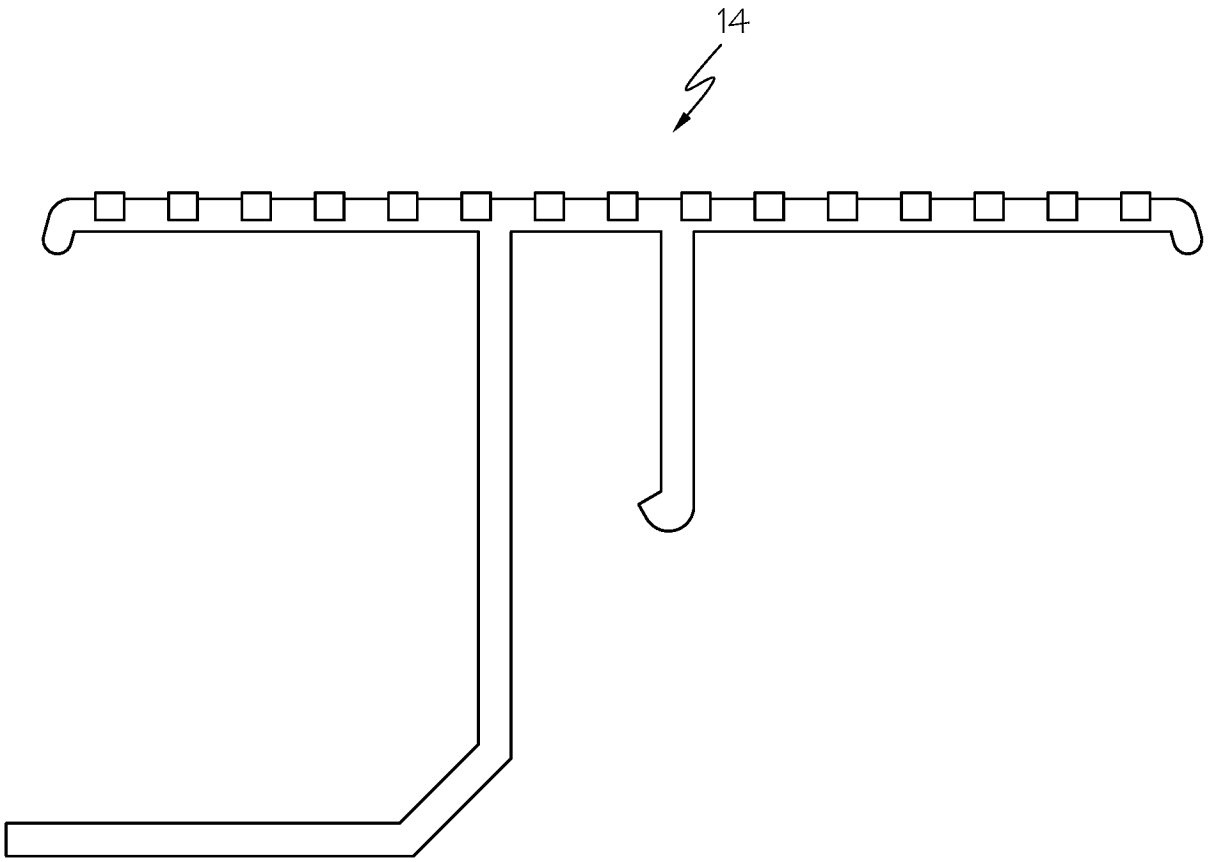
FIG. 7 shows a side cross-section view of a tread plate, including the shape which provides a slot for the deck board to fit into.
Figure 8:
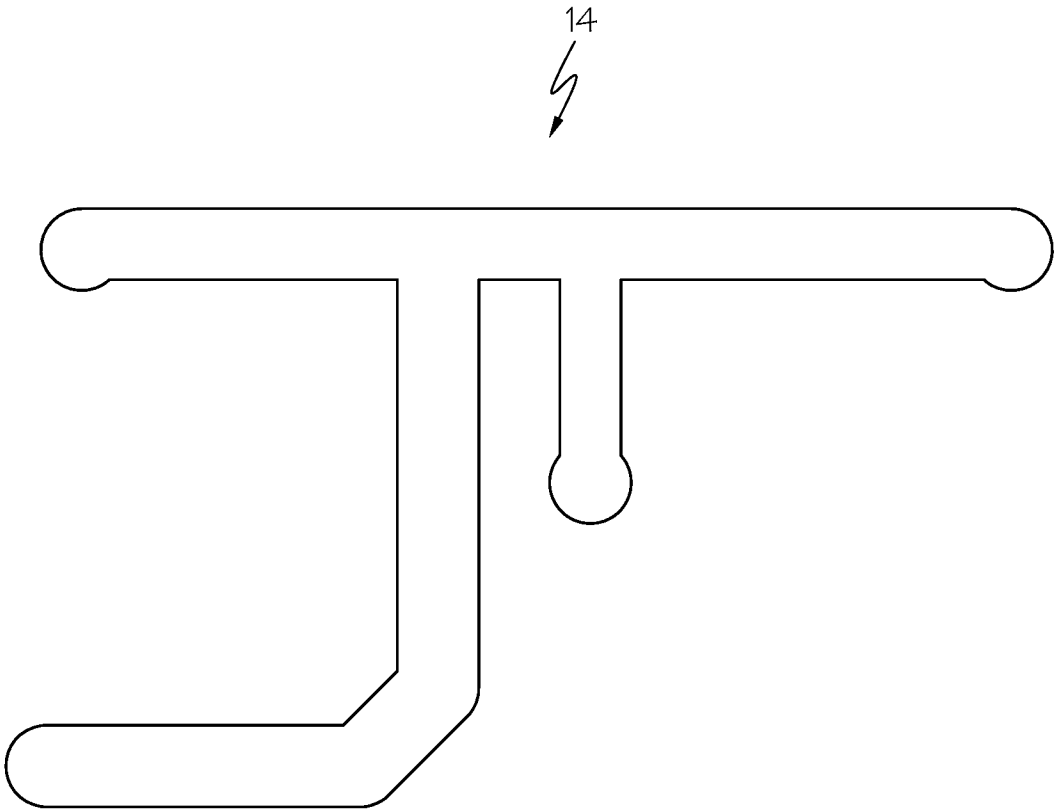
FIG. 8 shows a side cross-section view of a tread plate, including the shape which provides a slot for the deck board to fit into.
Figure 9:
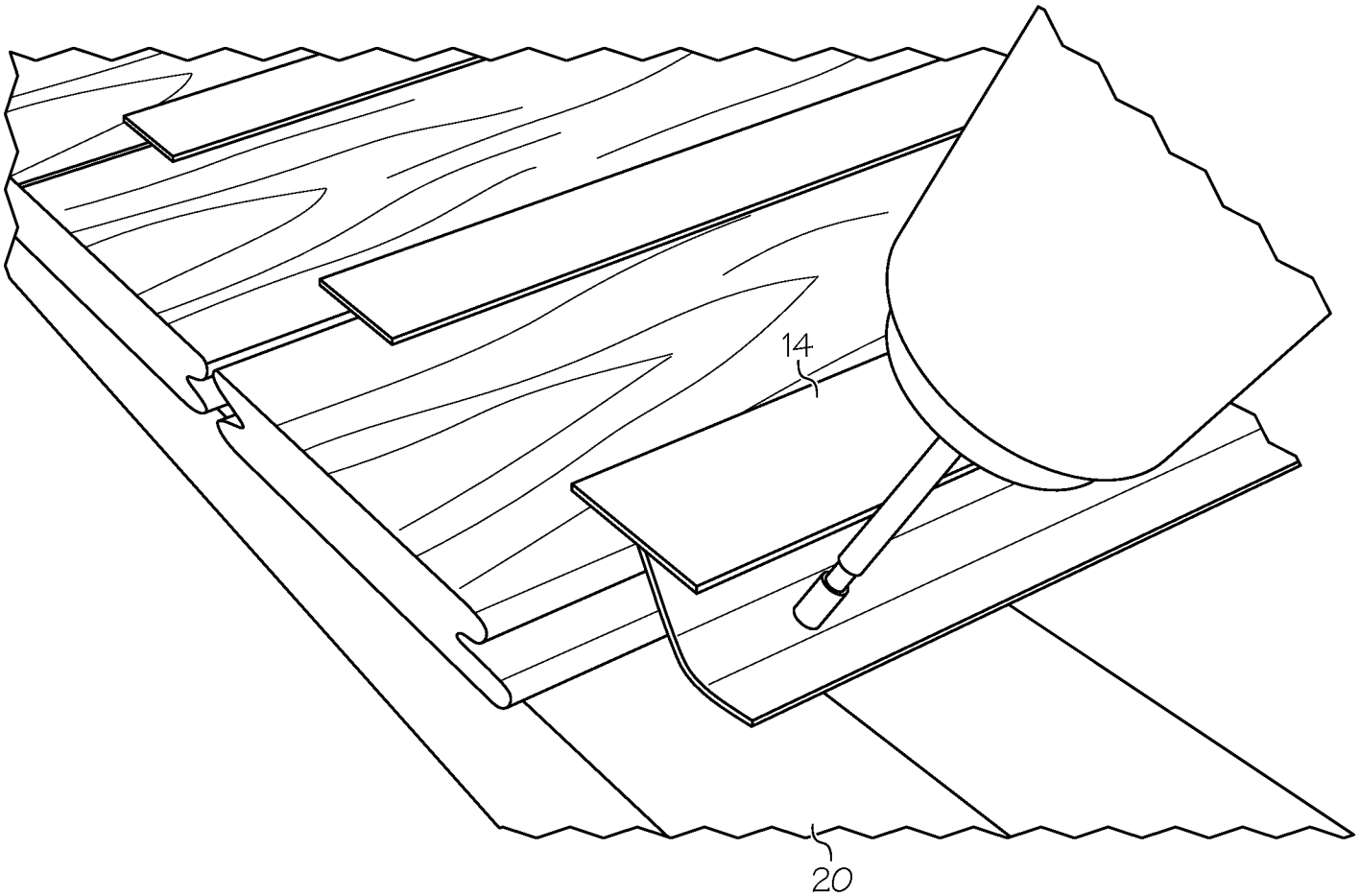
FIG. 9 shows the tread plate being attached to the stringers.

Referring now to FIGS. 6-9, the tread plate 14 is shown in more detail. Tread plate 14 can be made from any desired material, but is described here as extruded from aluminum or similar materials, and placed between each decking board 25. The tread plate 14 functions to secure the board 25 to the stringer (20 and 22), transition between boards 25 and create mechanical traction. Additionally, the tread plates 14 can include thread third party heat cable threaded through the tread plate components to increase the rate of snow and ice melt further increasing safety. FIG. 7 and FIG. 8 shows a side cross-section view of the tread plate 14, while FIG. 9 shows the tread plate being attached to the stringer 20.

Figure 10:
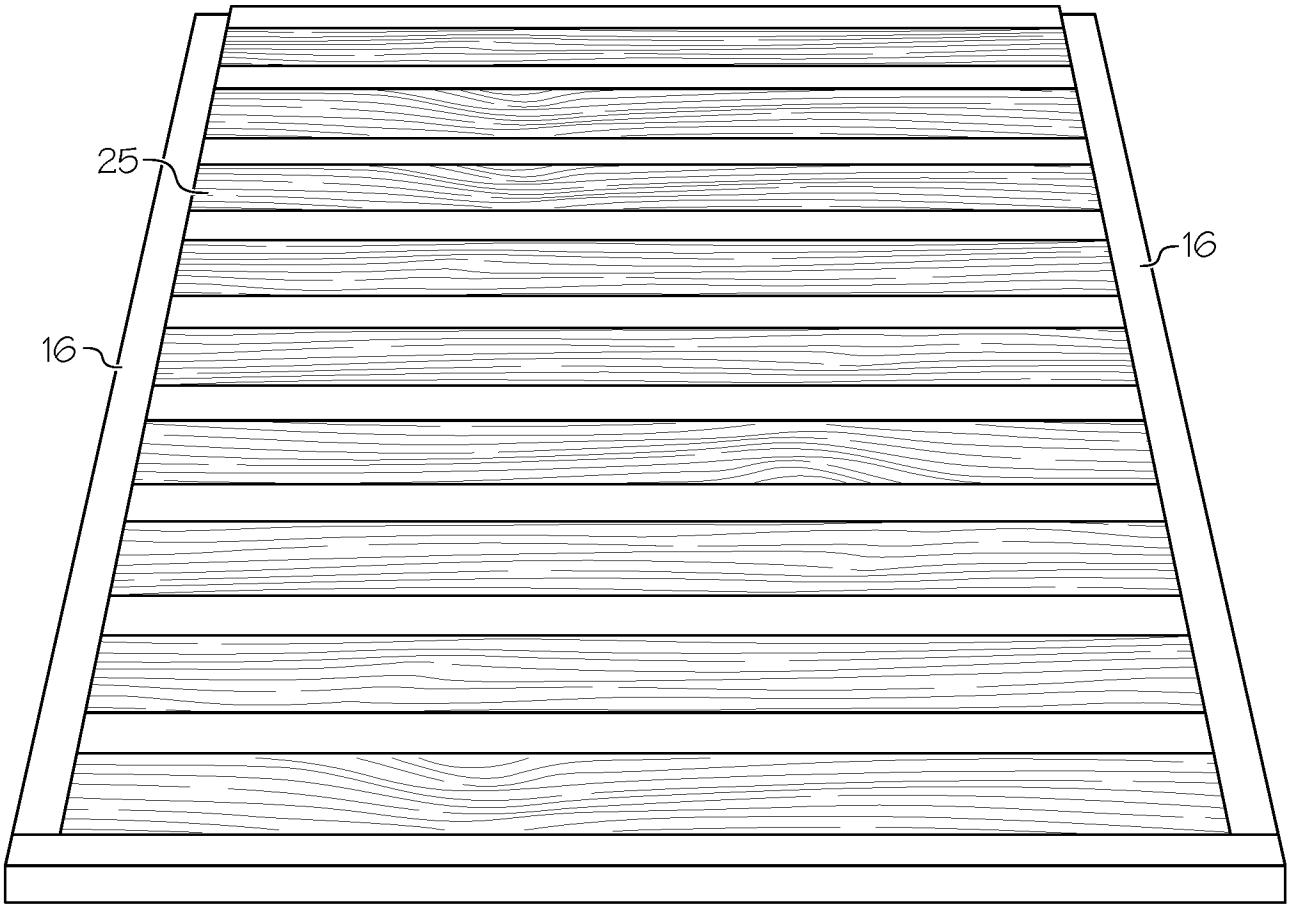
FIG. 10 shows the side caps 16 secured to the ramp stringers and decking material.
Figure 11:
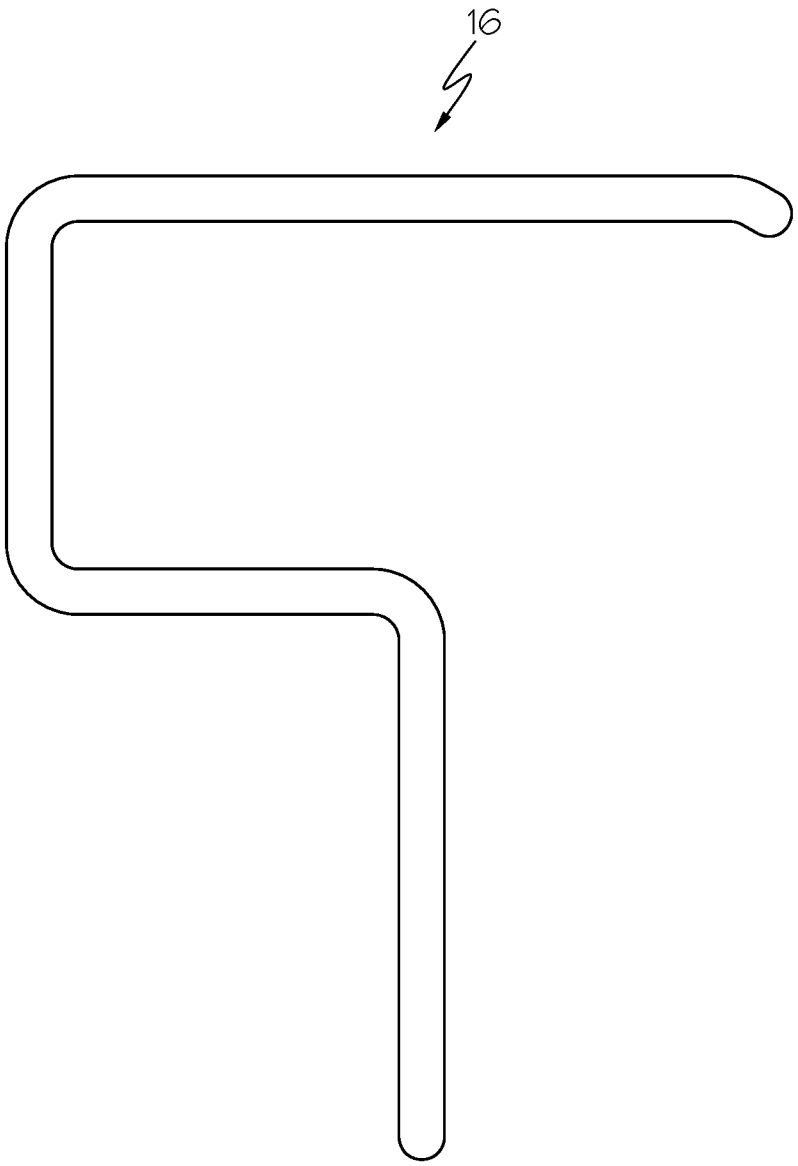
FIG. 11 shows the shape of the side caps 16.
Figure 12:
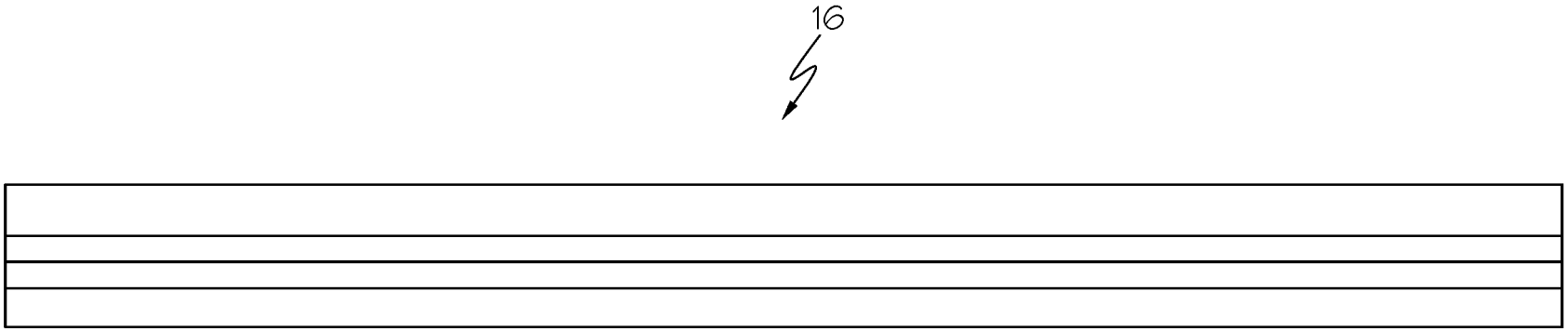
FIG. 12 shows the fold lines to bend the extruded aluminum into the shape shown in FIG. 11.

Referring now to FIGS. 10-12, the side caps 16 are described in more detail. The side caps 16 are placed on the outside edges of the decking boards 25 and attached to the outside stringers 20. The side caps are made of sheet metal made from aluminum or similar materials and bent four times into the shape shown in FIG. 11. The fold lines required to cut and bend the extruded aluminum into the shape for side cap 16 is shown in FIG. 12. The side caps 16 help secure the decking.

Figure 13:
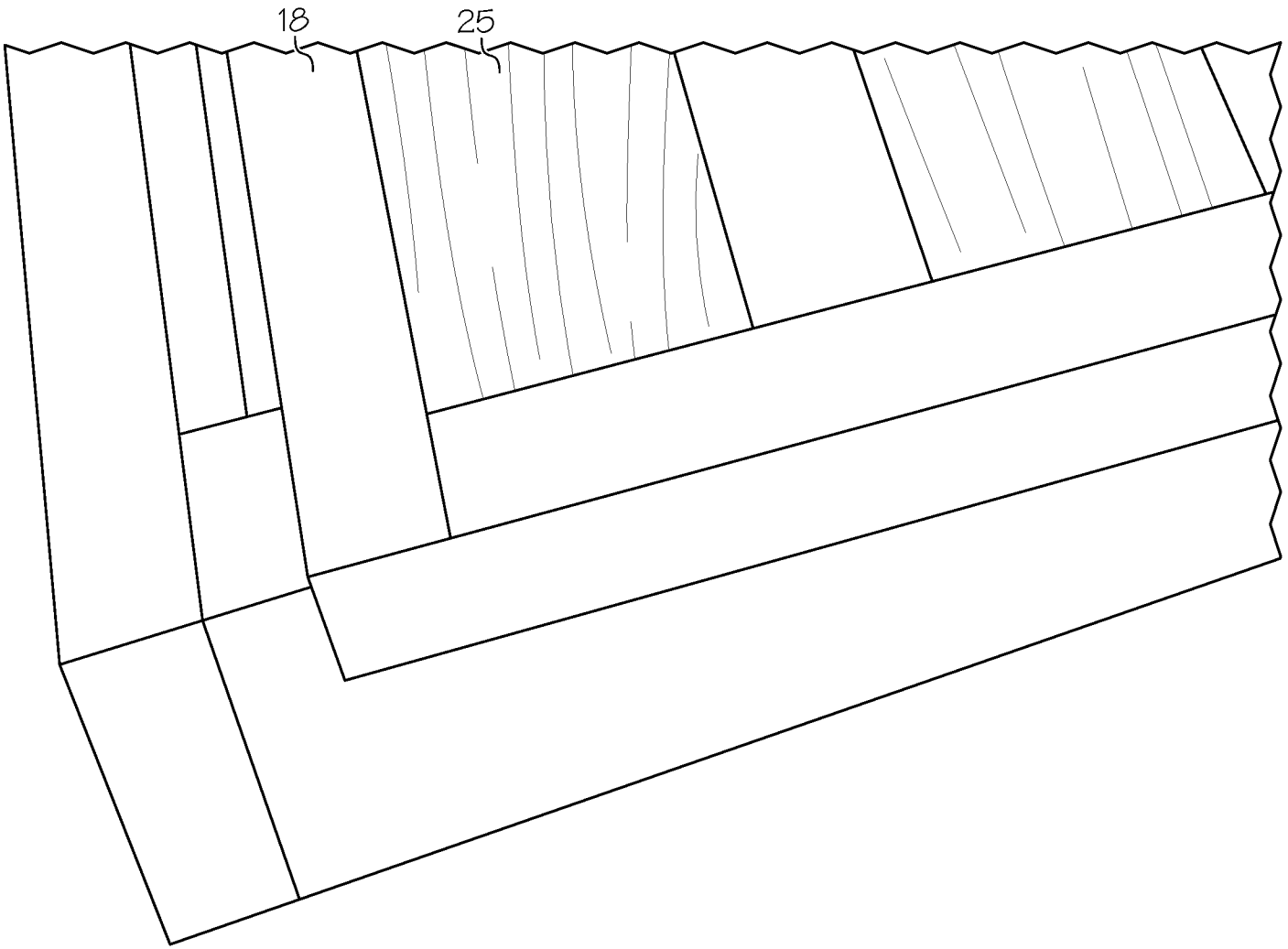
FIG. 13 shows the end cap which secures the final piece of decking material.
Figure 14:
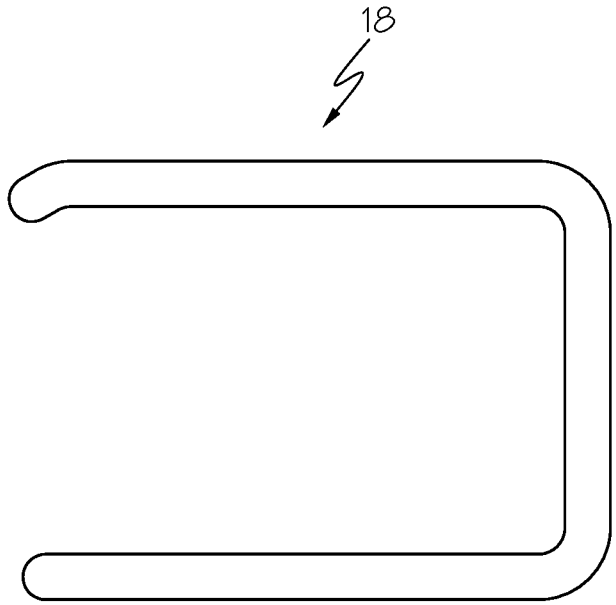
FIG. 14 shows the shape of the end cap part.
Figure 15:
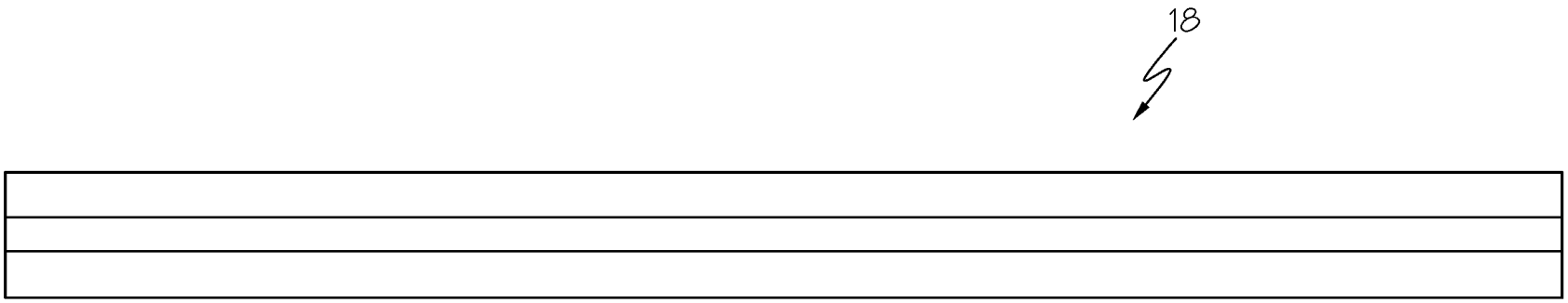
FIG. 15 shows the fold lines to bend the extruded aluminum into the shape shown in FIG. 14.

Referring now to FIGS. 13-15, the end cap 18 is described in more detail. The end cap 18 is placed at the top of the ramp and attached to the stringers 20 and 22 to secure the final board 25 being placed. It also creates the transition between the ramp and stairs, deck, porch or similar structure. The end cap can be made of any desired material, but is described here as made of sheet metal made from aluminum or similar materials and bent three times. The shape of the end cap 18 after folding is shown in FIG. 14, while the fold lines required to bend the extruded aluminum to form the end cap 18 are shown in FIG. 15. Additionally, third party heat cable can be threaded through the tread plate components to increase the rate of snow and ice melt further increasing safety.

The method of building the ramp is described in more detail below. The purpose of the Non-Slip Ramp System is to provide a convenient, reliable and safe way of creating ramps. The components included allow you to quickly assemble ramps that integrate your chosen composite, PVC, wood or similar decking material of choice and using appropriate off the shelf hardware assemble with fewer steps, hardware or measurements needed.

The process starts by placing the starter wedge component 12 for the bottom of the ramp. You then slide a board of decking material 25 into a groove facing up slope of the starter wedge 12. After the first deck board 25 is placed you slide a tread plate 14 onto the first board 25. Using off the shelf hardware you screw the tread plate 25 to the stringer boards 20 and 22. You then place the next board 25 and tread plate 14, repeating until you reach the top of the ramp stringers. When you reach the top of the ramp you attach two side caps 16 using off the shelf hardware appropriate to the material. Finally, you place the end cap 18 using off the shelf hardware appropriate to the materials.

Figure 16:
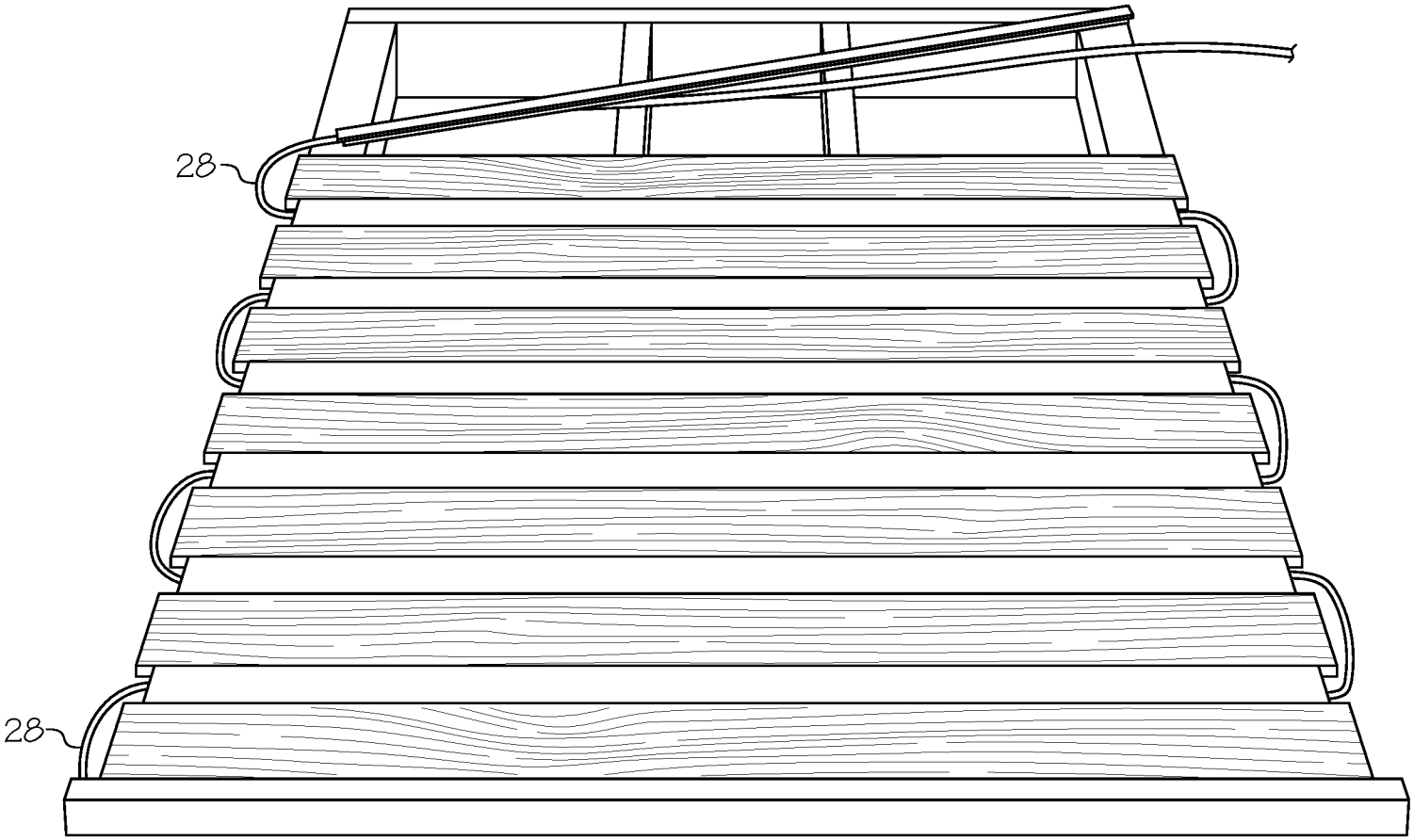
FIG. 16 shows the heat cable run through the starter wedge, and the tread plates.
Figure 17:
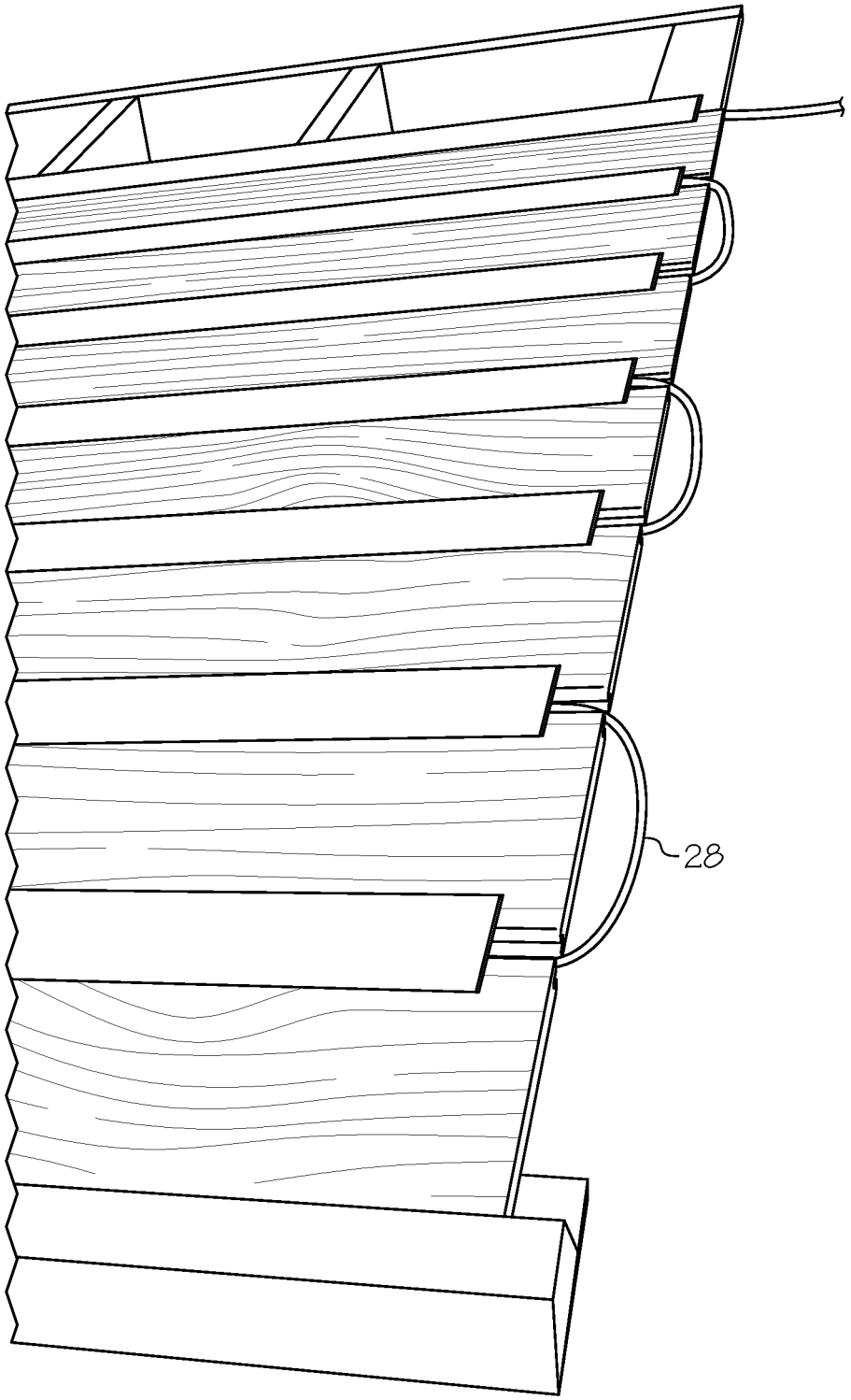
FIG. 17 shows the heat cable run through the tread plates.
Figure 18:
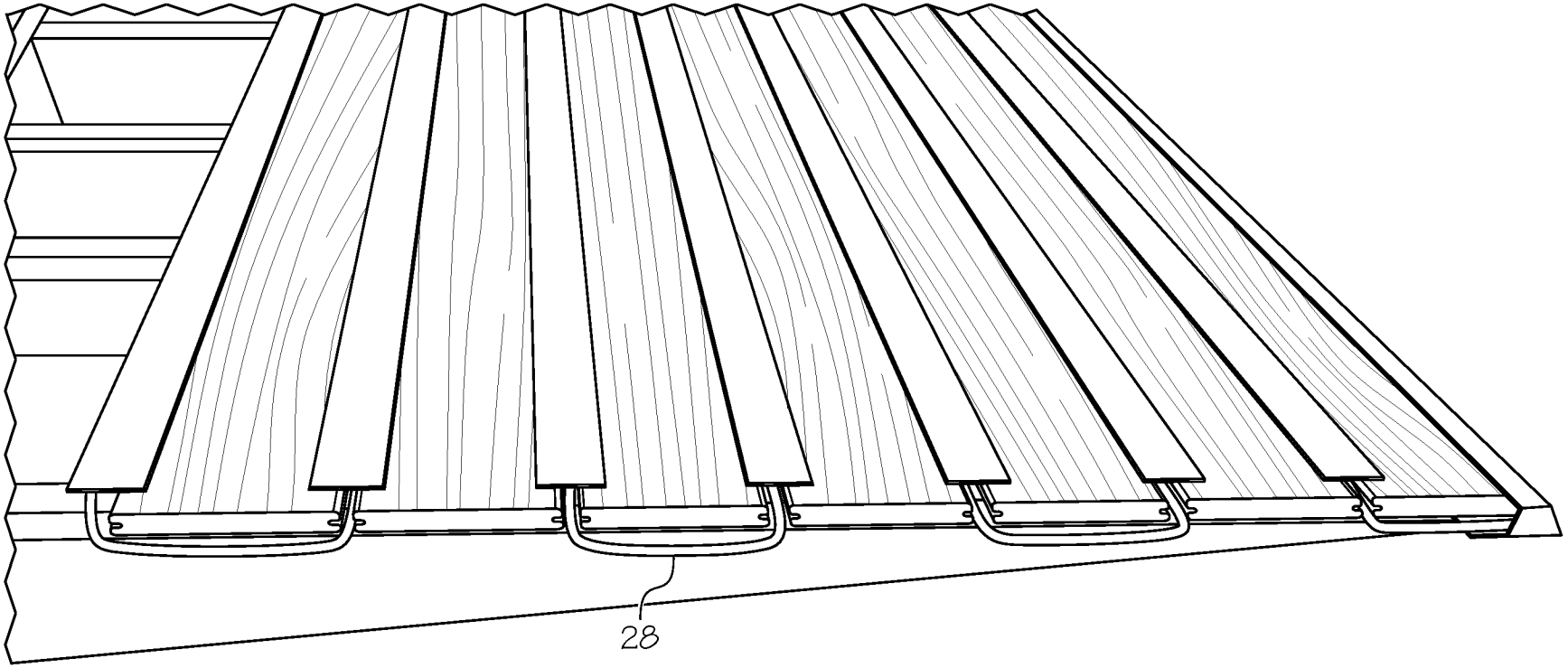
FIG. 18 shows a side view of the heat cable run through the starter wedge and tread plates.

Referring now to FIG. 16, the heat cable 28 run through the starter wedge, and the tread plates is shown. FIGS. 17 and 18 show other views of the heat cable 28 threaded between the starter wedge 12 and tread plates 14.

Using this system, the tread plates become mechanical traction. The top surface of the tread plate could also be roughed or shaped to provide additional traction. You can also increase traction with your choice in decking material. Lastly if you are able to incorporate third party heat cable via channels in the components to reduce ice and snow accumulation.

The above disclosure is intended to be illustrative and not exhaustive. This description will suggest many variations and alternatives to one of ordinary skill in this field of art. All these alternatives and variations are intended to be included within the scope of the claims where the term "comprising" means "including, but not limited to." Those familiar with the art may recognize other equivalents to the specific embodiments described herein which equivalents are also intended to be encompassed by the claims.

Further, the particular features presented in the dependent claims can be combined with each other in other manners within the scope of the invention such that the invention should be recognized as also specifically directed to other embodiments having any other possible combination of the features of the dependent claims. For instance, for purposes of claim publication, any dependent claim which follows should be taken as alternatively written in a multiple dependent form from all prior claims which possess all antecedents referenced in such dependent claim if such multiple dependent format is an accepted format within the jurisdiction (e.g. each claim depending directly from claim 1 should be alternatively taken as depending from all previous claims). In jurisdictions where multiple dependent claim formats are restricted, the following dependent claims should each be also taken as alternatively written in each singly dependent claim format which creates a dependency from a prior antecedent-possessing claim other than the specific claim listed in such dependent claim below.

This completes the description of the preferred and alternate embodiments of the invention. Those skilled in the art may recognize other equivalents to the specific embodiment described herein which equivalents are intended to be encompassed by the claims attached hereto.

What is claimed is:

1. A method of constructing a non-slip ramp comprising the steps of:

providing at least two sloped ramp stringers;

providing a sloped starter wedge having a sloped side and an open side;

sliding a piece of decking material into the open side of the starter wedge;

providing at least two tread plates, each providing spacing between adjacent pieces of decking material, each tread plate having a flat top section with a substantially L-shaped section attached perpendicular to the flat top section, with the bottom of the L fitting below one of the adjacent pieces of decking material, attaching the at least two tread plates to the at least two sloped ramp stringers;

providing an end-cap attached to a last piece of decking material.

2. The method of constructing a non-slip ramp of claim 1 wherein the starter wedge, tread plates and end cap are made of extruded aluminum which is cut and folded to form the starter wedge, tread plates and end cap.

3. The method of constructing a non-slip ramp of claim 1 further including the step of attaching side caps to the decking material and at least two stringers.

4. The method of constructing a non-slip ramp of claim 1 further including providing heat cable for melting snow and ice from the non-slip ramp.

5. The method of constructing a non-slip ramp of claim 1 wherein the starter wedge sloped side has an angle suitable for ramp building codes of one inch rise over twelve inch run.

6. A non-slip ramp comprising:

at least two sloped ramp stringers;

a starter wedge having a sloped side and an open side;

a non-slip deck board which slides into the open side of the starter wedge;

at least two tread plates, each providing spacing between two adjacent non-slip deck boards, each tread plate having a flat top section with a substantially L-shaped section attached perpendicular to the flat top section, with the bottom of the L fitting below one of the adjacent deck boards;

the at least two tread plates being attached to the at least two sloped ramp stringers;

an end-cap attached to a last non-slip deck board.

7. The non-skip ramp of claim 6 wherein the starter wedge, tread plates and end cap are made of extruded aluminum which is cut and folded to form the starter wedge, tread plates and end cap.

8. The non-slip ramp of claim 6 further including side caps which attach to the non-slip deck boards.

9. The non-slip ramp of claim 6 further including heat cable which melt snow and ice from the non-slip ramp.

10. The non-slip ramp of claim 6 wherein the starter ramp sloped has an angle suitable for ramp building codes of one inch rise over twelve inch run.

* * * * *